US005520509A

United States Patent [19]

Zimmerman

[11] Patent Number: 5,520,509

[45] Date of Patent: May 28, 1996

[54] FAN HOUSING

[75] Inventor: Leon S. Zimmerman, Lititz, Pa.

[73] Assignee: Staco, Inc., Schaefferstown, Pa.

[21] Appl. No.: 353,730

[22] Filed: Dec. 12, 1994

[51] Int. Cl.[6] ..... F04D 29/70

[52] U.S. Cl. ..... 415/121.200; 415/208.1; 415/211.2; 415/214.1; 416/244 R; 416/247 R; 403/11; 403/274

[58] Field of Search ..... 415/121.2, 208.1, 415/211.2, 214.1; 416/244 R, 247 R; 417/423.9, 423.14; 403/11, 233, 242, 274; 29/513, 521, DIG. 3

[56] References Cited

U.S. PATENT DOCUMENTS 5,221,180 6/1993 Crider .
5,237,734 8/1993 Polon ..... 29/513

FOREIGN PATENT DOCUMENTS 0040120 2/1989 Japan ..... 29/513

*Primary Examiner*—Edward K. Look
*Assistant Examiner*—Christopher Verdier
*Attorney, Agent, or Firm*—John G. Mills and Associates

[57] ABSTRACT

A fan housing having a peripheral wall disposed about the fan's axis of rotation. A plurality of flanges including reinforced hems are integrally formed with and extend perpendicularly of the peripheral wall toward the fan's axis of rotation. A screen fabricated from interconnected, perpendicular wire strands is coupled to the flanges by means of the reinforced hems with rigid but malleable tabs integrally formed thereon that are bent around a peripheral strand of the screen. Apertures are defined by and extend through the peripheral wall and the flanges to provide access to the tabs such that the tabs may be urged toward the flanges to secure the screen in position. The same apertures provide access to the tabs such that the tabs may be urged away from the flanges to disengage the peripheral strand from the tabs such that the screen may be removed and replaced.

1 Claim, 3 Drawing Sheets

FIG. 1
PRIOR ART
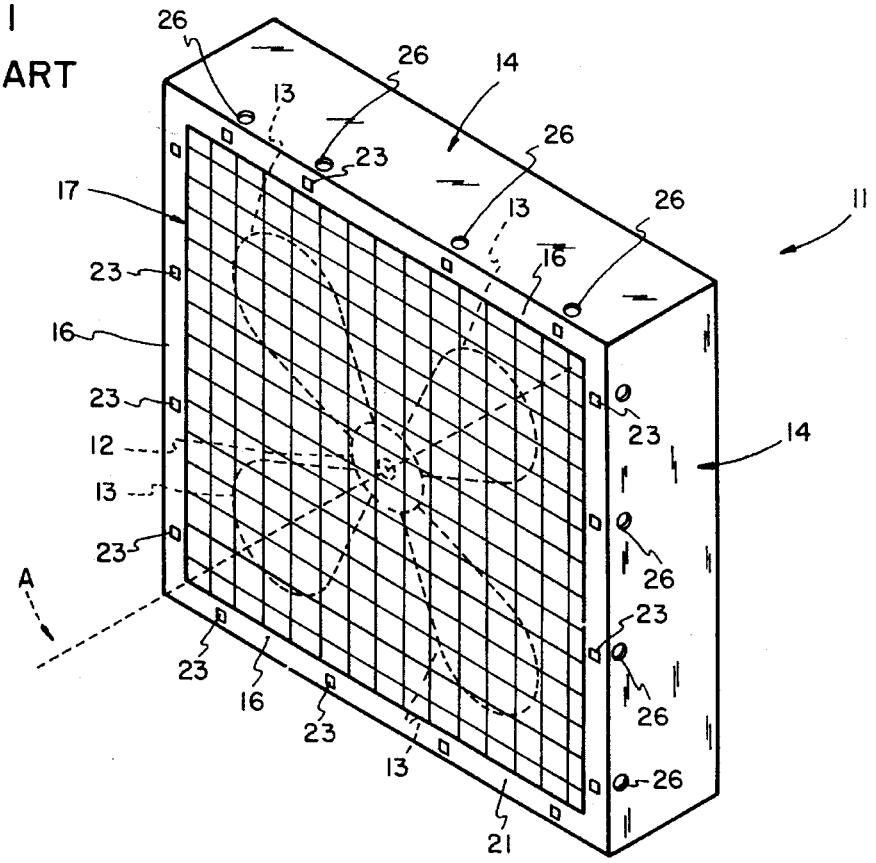
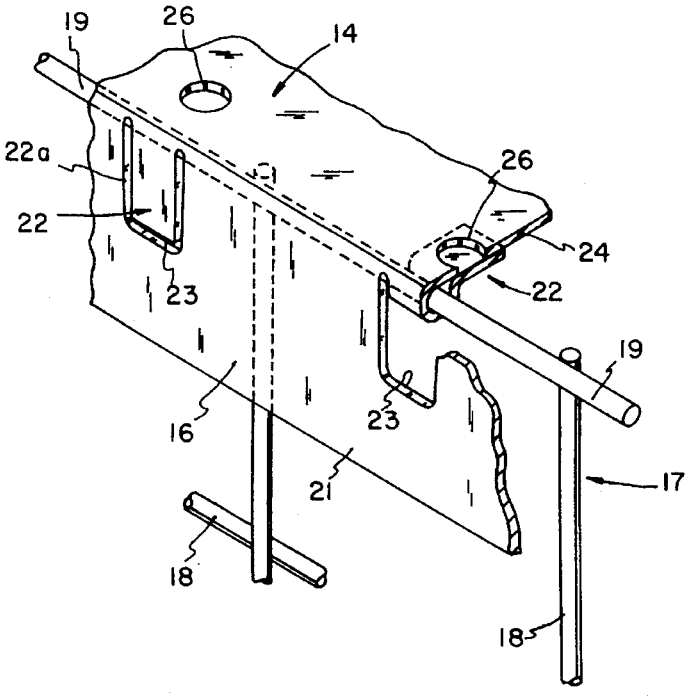
FIG. 2
PRIOR ART

FAN HOUSING

BACKGROUND OF INVENTION

The present invention relates to rotary fans and more particularly, to housings for the fans and their associated protective screens.

Rotary fans typically include a peripheral wall disposed about the fan's blades and motor in generally coaxial relation to the axis about which the blades are rotated. The peripheral wall extends axially beyond the blades and motor, which are mounted internally of the wall by a support member mechanically coupled thereto. A plurality of flanges extend from forward and rearward margins of the peripheral wall in generally perpendicular relation thereto, toward the axis about which the blades are rotated.

Screens are connected to the flanges to prevent the insertion of foreign objects into the fan.

The screens are constructed of perpendicular, interconnected wire strands and further include a peripheral strand defining the outer margin of the screen.

The screens are attached through the use of one or more flanges integrally connected to the peripheral wall and having a plurality of rigid but malleable tabs integrally connected to the flanges and forming a portion thereof that extends around the screens peripheral strands then toward the peripheral wall. However, the fan housings of the past do not significantly diminish the complexity in the manufacturing processes and the difficulties in the installation procedures required to secure the screen in its operative position in the fan housing.

Concise Explanation of Prior Art

U.S. Pat. No. 5,221,180 issued to Grantlin W. Crider on Jun. 22, 1993, discloses a metallic fan housing having a peripheral wall including a plurality of flanges integrally connected to the peripheral wall. At least one screen is connected to the flanges by rigid but malleable tabs formed thereon that are bent around a peripheral strand of the screen.

An array of apertures is defined by and extend through the flanges to provide access to the tabs such that the tabs may be urged toward the peripheral wall to tension the screen.

A separate array of holes is defined by and extend through the peripheral wall to provide access to the tabs such that the tabs may be urged from the peripheral wall to reduce the tension of the screen and to disengage the peripheral strand from the tabs such that the screen may be removed from the peripheral wall and replaced. This arrangement requires separate manufacturing operations for creating the array of apertures and the array of holes.

SUMMARY OF INVENTION

After much research and study into the above mentioned problems, the present invention has been developed to provide an improved fan housing with screen retaining means to overcome the manufacturing and installation complexities and other shortcomings of the prior art.

The fan housing of the present invention contemplates the use of a rotary fan positioned within a peripheral wall disposed about the fan's blades and motor in coaxial relation to an axis of rotation of the fan. The peripheral wall extends coaxially beyond the blades and motor, which are mounted internally of the wall by a support frame. A plurality of flanges are integrally formed with and extend perpendicularly of the peripheral wall in the direction of the fan's axis of rotation. The peripheral wall and flanges are constructed from galvanized or stainless steel or other suitable rigid but malleable metals.

In the present invention, the flanges incorporate a reinforcing hem, which is integrally formed with the flanges by breaking or folding a predetermined portion of the flanges to a 180 degree angle resulting in a double thickness of the flanges at their inner perimeter. The reinforcing hems include a plurality of rigid but malleable tabs integrally formed thereon.

A screen fabricated of perpendicular wire strands is placed within the peripheral wall adjacent the flanges and is engaged by folding the tabs about a peripheral wire strand defining the outer margin of the screen. The tabs may be accessed through apertures extending through the peripheral wall adjacent to the tabs and bent toward the flanges to secure the screen in position. The apertures are positioned such that the tabs may be bent away from their engaged position within the flanges to disengage the peripheral strand from the tabs to facilitate removal and replacement of the screen.

In view of the above, it is an object of the present invention to overcome the manufacturing complexities and other shortcomings of the prior art.

Another object of the present invention is to provide a fan housing with a reinforced mounting flange whereon a screen may be secured.

Another object of the present invention is to provide a fan housing that will facilitate the removal and replacement of damaged screens without disassembly of the peripheral wall of the fan housing.

Another object of the present invention is to provide a fan housing requiring fewer service apertures in the peripheral wall thereby reducing the number of machining processes and the cost of manufacture.

Other objects and advantages of the present invention will become apparent and obvious from a study of the following description and the accompanying drawings which are merely illustrative of such invention.

BRIEF DESCRIPTION OF DRAWINGS

FIG. 1 is a perspective view of a prior art fan housing;

FIG. 2 is a detailed perspective of a prior art fan housing;

DESCRIPTION OF THE PREFERRED EMBODIMENT

Figure 3:
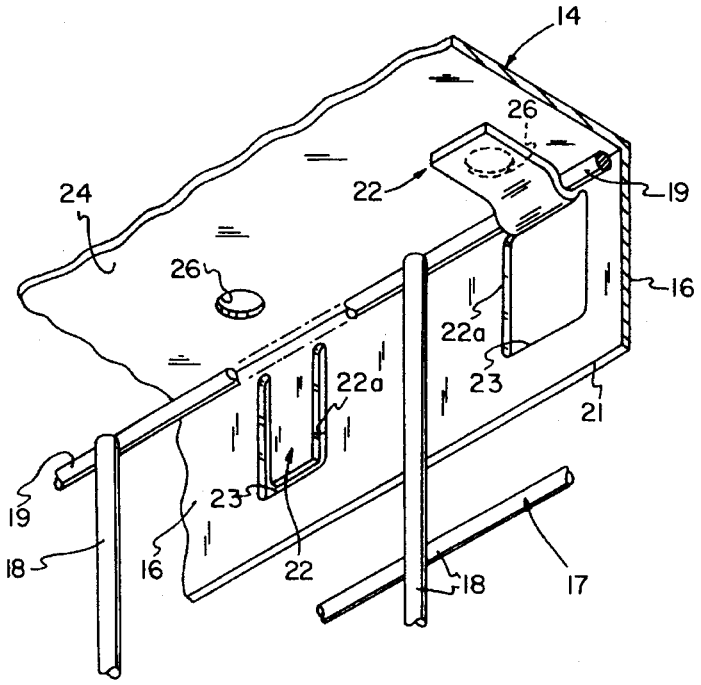
FIG. 3 PRIOR ART
FIG. 3 is a detailed perspective view taken from within the prior art fan housing and showing a tab engaging a peripheral strand.

As background, and to better understand by comparison the fan housing with screen securing means of the present invention to be described in detail, reference should be made to the Crider fan housing illustrated in FIG. 1 and labeled prior art. This previously issued patent contemplates the use of a fan indicated generally at 11, having a hub 12 with blades 13 that rotate about an axis of rotation A. The hub 12 and driving motor (not shown) are mounted within a metallic peripheral wall, indicated generally at 14, that is spaced about the axis A and extends axially beyond the fan 11. The plurality of metallic flanges 16 are integrally connected to and extend substantially perpendicularly of the peripheral wall 14 toward the axis A. A metallic wire screen, indicated generally at 17, is mounted to the flanges 16 on either side of fan 11.

As shown in FIGS. 1 and 2 labeled prior art, the screen 17 includes a plurality of perpendicular interconnected strands 18 and a peripheral strand 19 which forms a perimeter measuring less than the peripheral wall 14 and more than an inner perimeter 21 defined by the inner most edges of the plurality of flanges 16. The plurality of flanges 16 have a plurality of rigid but malleable tabs 22 formed thereon. The tabs 22 are formed by cutting a profile 22*a* of the tabs 22 within the flange 16 as shown in FIG. 2.

The assembly of the housing and screen 17 is accomplished by placing the screen 17 within the peripheral wall 14 between the flanges 16 and the fan blades 13. The strand 19 is engaged by folding the tabs 22 about the strand 19 toward the peripheral wall 14. The tabs 22 extend from the flanges 16 a short distance toward the axis A and around the peripheral strand 19. Folding the tabs 22 opens a plurality of apertures 23 that are formed thereby intermediate the perimeter 21 and peripheral strand 19 when the tabs 22 are cut and folded from the flanges 16.

As shown in FIG. 2, the tabs 22 may be accessed through the apertures 23 and urged toward the peripheral wall 14 and against an interior face 24 of peripheral wall 14 to tension screen 17 and secure the screen at a selected tensioned position.

Holes 26 are defined by and extend through the peripheral wall 14 proximal to the tabs 22. The holes 26 provide access to the tabs 22 such that the tabs 22 may be urged downwardly from the peripheral wall 14 and from the interior surface 24 to reduce the tension of screen 17. Continued movement of the tabs 22 from the peripheral wall 14 will disengage the peripheral strands 19 from the tabs 22 to facilitate removal and replacement of the screen 17.

Figure 4:
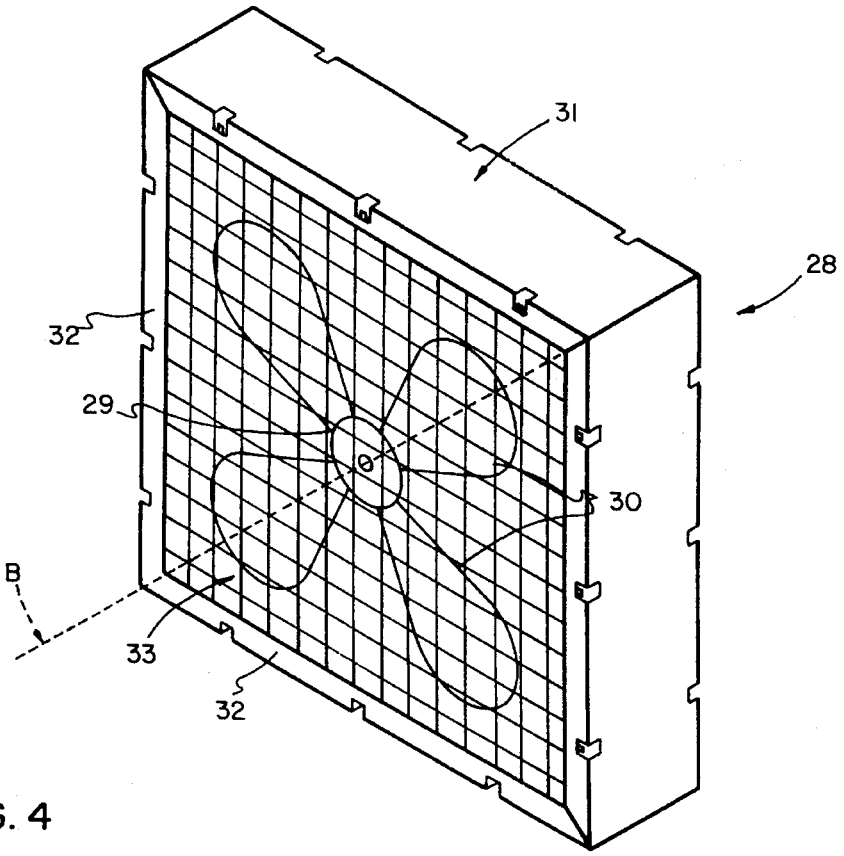
FIG. 4 is a perspective view of the present invention.

Referring now to the fan housing of the present invention as shown in FIG. 4, it will be seen that it also contemplates the use of a fan indicated generally at 28, having a hub 29 with blades 30 that rotate about an axis of rotation B. The hub 29 and driving motor (not illustrated) are positioned within a peripheral wall indicated generally at 31 that is disposed about the axis B and extends axially beyond the fan 28. A plurality of flanges 32 are integrally formed with and extend substantially perpendicularly of peripheral wall, indicated generally at 31, in the direction of axis B. The peripheral wall 31 and flanges 32 are constructed from galvanized steel or stainless steel or other such rigid but malleable metals. A wire screen, indicated generally at 33 is coupled to the flanges 32 on either side of the fan 28.

Figure 5:
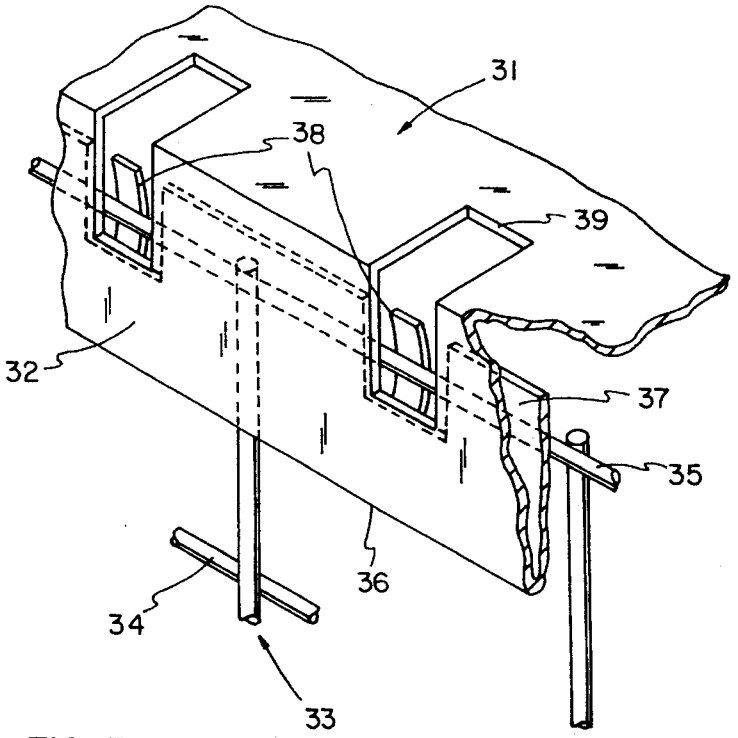
FIG. 5 is a detailed perspective view of the present invention.

As shown in FIG. 5, the screen 33 includes a plurality of perpendicular interconnected strands 34 and a peripheral strand 35 which forms a perimeter measuring less than the peripheral wall 31 and more than an inner perimeter 36 defined by the inner edges of the plurality of flanges 32.

As will be appreciated by referring to FIG. 5, in the present invention flanges 32 further include hems 37 which are integrally formed with flanges 32 by folding or breaking a predetermined portion of flanges 32 to a 180 degree angle resulting in a double thickness of flanges 32 at inner perimeter 36.

Figure 6:
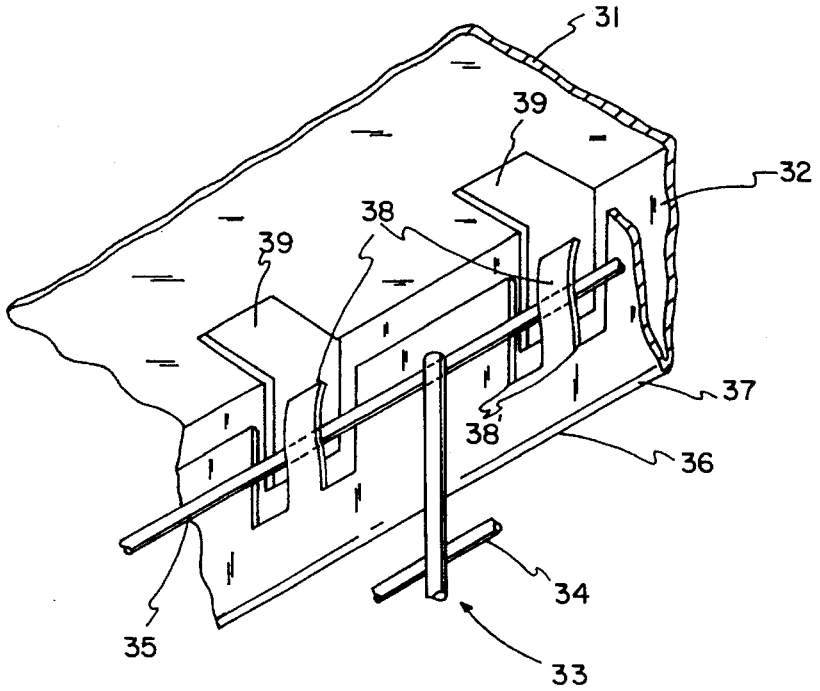
FIG. 6 is a detailed perspective view taken from within the present invention and showing a tab engaging a peripheral strand.

Hems 37 formed on flanges 32 include a plurality of rigid but malleable tabs 38 integrally formed thereon. Tabs 38 are formed by cutting a profile 38' of tabs 38 within hem 37 as shown in FIG. 6.

In an assembly procedure of the fan housing and screen 33 of the present invention, tabs 38 are bent inwardly toward the axis B to a position generally perpendicular to flanges 32. Screen 33 is placed within peripheral wall 31 juxtaposed to flanges 32. Peripheral strand 35 is engaged by folding tabs 38 about peripheral strand 35 toward flanges 32. Tabs 38 extend from hems 37 a short distance axially and around peripheral strand 35. As shown in FIG. 5, tabs 38 may be accessed through apertures 39 and urged toward the flanges 32 to secure screen 33 in position.

Apertures 39 are defined by and extend through peripheral wall 31 and flange 32 and are generally disposed at predetermined intervals at the juncture of the peripheral wall 31 and the flanges 32. Apertures 39 are juxtaposed with tabs 38 providing access to the tabs 38 such that the tabs 38 may be bent downwardly from an engaged position with flanges 32 to disengage the peripheral strands 35 from the tabs 38 to facilitate removal and replacement of the screen 33, when necessary.

From the above it can be seen that the present invention provides an improved fan housing including reinforced screen retaining means which facilitates the removal and replacement of damaged screens and reduces manufacturing costs.

The terms "upper", "lower", "side", "inner", "outer", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A method of installing a screen within a rotary fan housing of the type having a peripheral wall spaced about an axis of rotation of a rotary fan disposed therein; a plurality of flanges integrally formed with and disposed generally perpendicularly to said peripheral wall toward said axis of rotation, said flanges including a plurality of hems integrally formed thereto, said hems including screen retaining means including a plurality of rigid but malleable tabs integrally formed thereto and extending outwardly from said axis of rotation and in generally perpendicular relation to said peripheral wall, said peripheral wall and said flanges defining a plurality of apertures positioned at the intersection thereof and being disposed in juxtaposition to said tabs; and at least one screen having a plurality of perpendicular interconnected strands including at least one peripheral strand forming a perimeter thereof and measuring less than the inside dimension of said peripheral wall and more than an inner perimeter defined by said plurality of flanges, said method comprising:

accessing said tabs through said apertures;

bending said tabs inwardly 90 degrees such that said tabs lie in plane generally perpendicular to said flanges and parallel to said peripheral wall;

positioning said screen within said housing and adjacent said hems such that said peripheral strand is disposed intermediate said tabs and said peripheral wall; and engaging said peripheral strand of said screen by bending said tabs 90 degrees in a reverse direction to their original position parallel to said flanges and perpendicular to said peripheral wall to retain said screen.

* * * * *